US005242122A

United States Patent [19]

Bogen

[11] Patent Number: 5,242,122

[45] Date of Patent: Sep. 7, 1993

[54] METHOD AND ARRANGEMENT FOR FINELY GRINDING MINERALS FOR USE AS FILLERS

[75] Inventor: Jan O. Bogen, Kvicksund, Sweden

[73] Assignee: Sala International AB, Sala, Sweden

[21] Appl. No.: 854,715

[22] Filed: Mar. 23, 1992

[30] Foreign Application Priority Data

Mar. 25, 1991 [SE] Sweden ..... 9100884

[51] Int. Cl.[5] ..... B02C 25/00

[52] U.S. Cl. ..... 241/30; 241/34; 241/171; 241/172

[58] Field of Search ..... 241/34, 171, 172, 30

[56] References Cited

U.S. PATENT DOCUMENTS

| | | | |
|---|---|---|---|
| 1,990,178 | 2/1935 | Frisch | 241/34 |
| 2,111,663 | 3/1938 | Graemiger | 241/34 X |
| 2,136,907 | 11/1938 | Roder | 241/34 |
| 2,491,466 | 12/1949 | Adams | 241/34 |
| 2,498,089 | 2/1950 | Lippman, Jr. | 241/34 X |
| 2,602,594 | 7/1952 | Hesse | 241/34 |
| 3,179,345 | 4/1965 | Kivert et al. | 241/171 X |
| 3,779,469 | 12/1973 | Putman | 241/34 X |
| 3,860,804 | 1/1975 | Rutman | 241/34 X |
| 3,957,210 | 5/1976 | Dürr | 241/171 X |
| 4,303,205 | 12/1981 | Geiger et al. | 241/172 X |
| 4,998,678 | 3/1991 | Dürr | 241/171 |
| 5,133,506 | 7/1992 | Bogen | 241/46.17 |

FOREIGN PATENT DOCUMENTS 0369149 5/1990 European Pat. Off. .

OTHER PUBLICATIONS

Recent Developments in Stirred Ball Milling, International Journal of Mineral Processing, 22(1988), pp. 431–444.

*Primary Examiner*—Mark Rosenbaum
*Assistant Examiner*—Frances Chin
*Attorney, Agent, or Firm*—Nils H. Ljungman & Associates

[57] ABSTRACT

The present invention relates to a method and an arrangement for finely-grinding minerals and similar material intended for use as filler material to a particle size appropriate for this purpose, with a mill which operates by agitating grinding medium and in which the material is ground in a substantially dry state. The invention is characterized by predetermining the stay time of the material being ground in the mill; maintaining the predetermined stay time partly by discharging ground material from the mill at a predetermined, essentially constant rate, and partly by adjusting the infeed of material to the mill in relation to the quantity of material discharged from the mill by the amount of material present in the mill increases during the infeed of material thereto; and by interrupting the infeed of material to the mill over a predetermined short period of time when the material reaches a predetermined highest level in said mill.

The arrangement includes a first motor-driven device which functions to control the infeed of material, a mill for grinding with the aid of an agitated grinding medium, a perforated disc which functions to separate grinding medium from the ground material leaving the mill, a second motor-driven device which functions to maintain a substantially constant outfeed of ground material from the mill, and a level monitor which is mounted in the upper part of the mill and connected to the motor-driven infeed device.

18 Claims, 2 Drawing Sheets

METHOD AND ARRANGEMENT FOR FINELY GRINDING MINERALS FOR USE AS FILLERS

BACKGROUND INFORMATION

1. Field of the Invention

The present invention relates to a method for finely-grinding minerals and similar materials down to a particle size which will render the ground material suitable for use as a filler, using herefor a mill in which the minerals or like material are ground by means of an agitated grinding medium and in which said minerals or like material are ground while in a substantially dry state. The invention also relates to a mill arrangement for use when carrying out the inventive method.

2. Background Information:

Minerals and similar materials which are to be used as a filler in the production of different products, for example, in the manufacture of paper, plastics, paints, coatings, adhesive products and sealing materials, must have an average particle size which lies at least beneath 45 μm (97%). Furthermore, it is necessary that the material has a specific surface area corresponding to a Blaine-number greater than 400 $m^2/kg$. In the majority of cases, an average particle size smaller than 10 μm is required, for instance when the material is used as a filler in paper and paints, while certain other applications require a still finer particle size, so-called ultrafine particles having an average particle size or grain size of $<2$ μm, for example, when used as a filler in paper coatings.

In certain cases, the filler material used for these purposes may comprise a precipitate which already has the desired particle size, or a particle size which lies close to the desired particle size, although filler materials are normally produced by a grinding process that includes a fine grinding stage in which minerals or similar natural materials are ground to a desired particle fineness. Standard materials from which fillers are produced include different carbonate materials, such as limestone or dolomite, different sulphate materials, such as gypsum, and silicon-based material, for example, clays, such as kaolin. Fine-grained products of this kind cannot be readily produced by wet grinding processes, which wet grinding processes are normally applied for grinding minerals down to desired fineness, since a wet-ground product needs to be subsequently dried. The fine material tends to lump together during this drying process and the resulting agglomerates need to be broken down in a further grinding process. The capital investment required herefor renders the wet grinding alternative prohibitive in the majority of cases. In consequence, it is necessary to use a dry grinding process, which in the present case implies a choice between a roller mill or a mill which functions with an agitated grinding medium. A rolling mill can only be used to produce relatively coarse filler material, although it is feasibly possible to produce products having a grain or particle size in the order of 3 μm, when milling in combination with air sieving, by circulating large volumes of material through the mill.

So-called attrition grinding has been proposed with the aim of producing ultrafine products. Attrition grinding can be achieved in a mill operating with an agitated grinding medium, as described in more detail herebelow.

The technique of grinding down material with the aid of an agitated medium (Stirred Ball Milling) has been known to the art for almost 60 years. The technique had its industrial breakthrough in 1948, in conjunction with pigment grinding in the paint and lacquer industry. The technique has been developed progressively during recent years and has obtained increased application. As a result, many different types of grinding mills that use an agitated medium have been proposed, as is evident, for instance, from an article published in International Journal of Mineral Processing, 22 (1988), pages 431–444. One of these mills is equipped with pin agitator rotors by means of which the requisite grinding energy is introduced by forced displacement of the grinding medium.

Because the mill is able to grind material rapidly down to extremely fine-grain sizes, normally within the range of 1–10 μm, the technique of grinding with the aid of an agitated medium has been applied to an increasing degree for various types of material. For example, fine grinding of this nature is applied in the production of fine-grain products within the fields of paint and lacquer technology, pharmacology, electronics, agrochemistry, foodstuffs, biotechnology, rubber, coal and energy. Examples of this latter case include coal-oil-mixtures and coal-water-suspensions. The technique of grinding with an agitated medium is now also being applied within the mineral processing field. Examples of such application include the grinding of limestone, kaolin, gypsum, aluminium hydroxide and the manufacture of paper fillers and paper coating materials, as before mentioned.

The results of experiments and tests carried out in recent years have shown that when grinding with an agitated grinding medium, the fineness of the ground material is dependent solely on the specific energy input, which can be expressed in kWh/tonne of material ground. Furthermore, it is found that the advantages afforded by this grinding technique over the alternative techniques is greatly enhanced with increasing fineness of the ground material, in other words grinding with an agitated grinding medium becomes more attractive with the desired fineness of the end product. Thus, a finer end product requires a higher specific energy input, i.e. a higher specific power input and/or longer grinding time. Obviously, it is preferred primarily to try with a higher power input, so as not to negatively influence the productivity of the mills concerned. Grinding times of 6–8 hours, which have been suggested, for instance, in conjunction with the grinding of pyrites in South Africa, are naturally not so attractive, although in many cases necessary, since a higher power input would place even greater demands on the ability of the mill to withstand a harsh environment, particularly when grinding harder materials.

A suitable mill for grinding materials down to very fine-grain sizes with a high power input is described in our earlier Patent Specification SE-A-9000797-2 which corresponds to U.S. Pat. Nos. 5,133,506.

However, a serious problem is encountered when finely-grinding dry material in a mill that operates with an agitated grinding medium, namely that large quantities or volumes of material must be circulated in the process and wind sieved, similarly to the case in other types of dry grinding processes, as mentioned in the introduction. It is necessary to circulate through the mill up to 200–300% of the product taken from the mill, in order to obtain the desired fine-grain product subsequent to sieving. This is mainly due to the difficulties experienced in controlling the stay time, or residence time, in the mill in relation to power input and therewith to the grinding energy per unit of weight, which is, in turn, directly influenced by the grain size of the end product. When wet grinding in mills of this kind, the stay time can be readily controlled by controlling the flow of incoming and/or outgoing slurry, by means of the slurry pumps used. Swedish Patent Application No. SE-A-9003858-1, now withdrawn and not published, teaches an improved method and an improved arrangement for finely-grinding dry minerals and similar materials intended for use as a filler, down to grain sizes suitable for this purpose. According to this method, the stay time of the material to be ground is first determined with respect partly to the ingoing particle size of the material and partly to the outgoing grain size, and also to the grinding properties of the material, which can often be determined empirically. The material is then introduced into the mill in an essentially dry state, by which is meant that the moisture content of the material must not exceed about 0.5%. The thus predetermined stay time is maintained partly by controlling and steering the infeed of material to the mill such as to maintain said infeed as constant as possible at a predetermined value, and partly by controlling and steering the outfeed from the mill in a manner which will keep the volume of material present in the mill substantially constant at each moment in time. The quantity of material present in the mill is determined by continuously weighing the mill together with its content of grinding medium and the material being ground. Any upward or downward deviation from a constant value of this mass causes signals to be sent from the weighing device to an outfeed valve, which in response to said signals either decreases or increases the flow of material exiting from the mill, such as to return the mill content to said constant value.

This earlier method is thus based on the concept of maintaining the material undergoing grinding in the mill at a constant volume, as far as possible, during the whole of the grinding process, thereby obtaining a defined energy input per unit of weight of material in the mill, which defined energy input is a measurement of the stay time of the material in said mill and therewith also directly proportional to the fineness of the ground material taken from the mill.

In some cases, however, the process of continuously monitoring variations in the total weight of the mill has created problems. These problems are primarily encountered in the case of large mill constructions and in materials that are lighter in weight, where the weight variations in time may be so small in relation to the total weight as to render it difficult to record these variations continuously to the desired degrees of accuracy with the aid of commercially-available scales, even though a weighting factor is used to account for the weight of the mill.

OBJECT OF THE INVENTION

There is therefore a great need, primarily in the manufacture of fillers, of an improved method for dry grinding materials in mills which operate with an agitated grinding medium, which method is capable of utilizing the technical and economical advantages afforded by this type of mill, by eliminating the necessity of circulating large volumes of materials through the mill. This would enable the filler material to be produced for all conceivable applications in a fashion which is attractive, both technically and economically.

SUMMARY OF THE INVENTION

It has now surprisingly been found possible to provide a simple, alternative method and arrangement for finely-grinding dry minerals and similar materials in which it is not necessary to weigh the mill and its contents continuously.

The inventive method and arrangement are characterized by the method steps and the features set forth in the following Claims.

Thus, the present invention involves firstly determining the stay time, or residence time, of the material present in the mill and being finely ground therein. This predetermined stay time, and therewith also the grinding energy per unit of weight of material, is maintained partly by discharging a predetermined, substantially constant volume of ground material from the mill, and partly by adjusting the volume of material fed to the mill in relation to the volume of material discharged from the mill such that the volume of material present in the mill will increase during the mill charging stage, i.e. the infeed stage. The infeed of material to the mill is interrupted in response to a signal produced by a level monitor mounted in the upper part of the mill, i.e. when the level of material in the mill has reached a highest, predetermined level. This interruption in the infeed of material to the mill is maintained during a predetermined, short period of time, e.g. after, for example, a given time point or upon receipt of a signal from a second level monitor located beneath the first monitor.

BRIEF DESCRIPTION OF THE DRAWINGS

The inventive method and arrangement will now be described in more detail with reference to the accompanying drawings, of which

DESCRIPTION OF THE PREFERRED EMBODIMENTS

Figure 1:
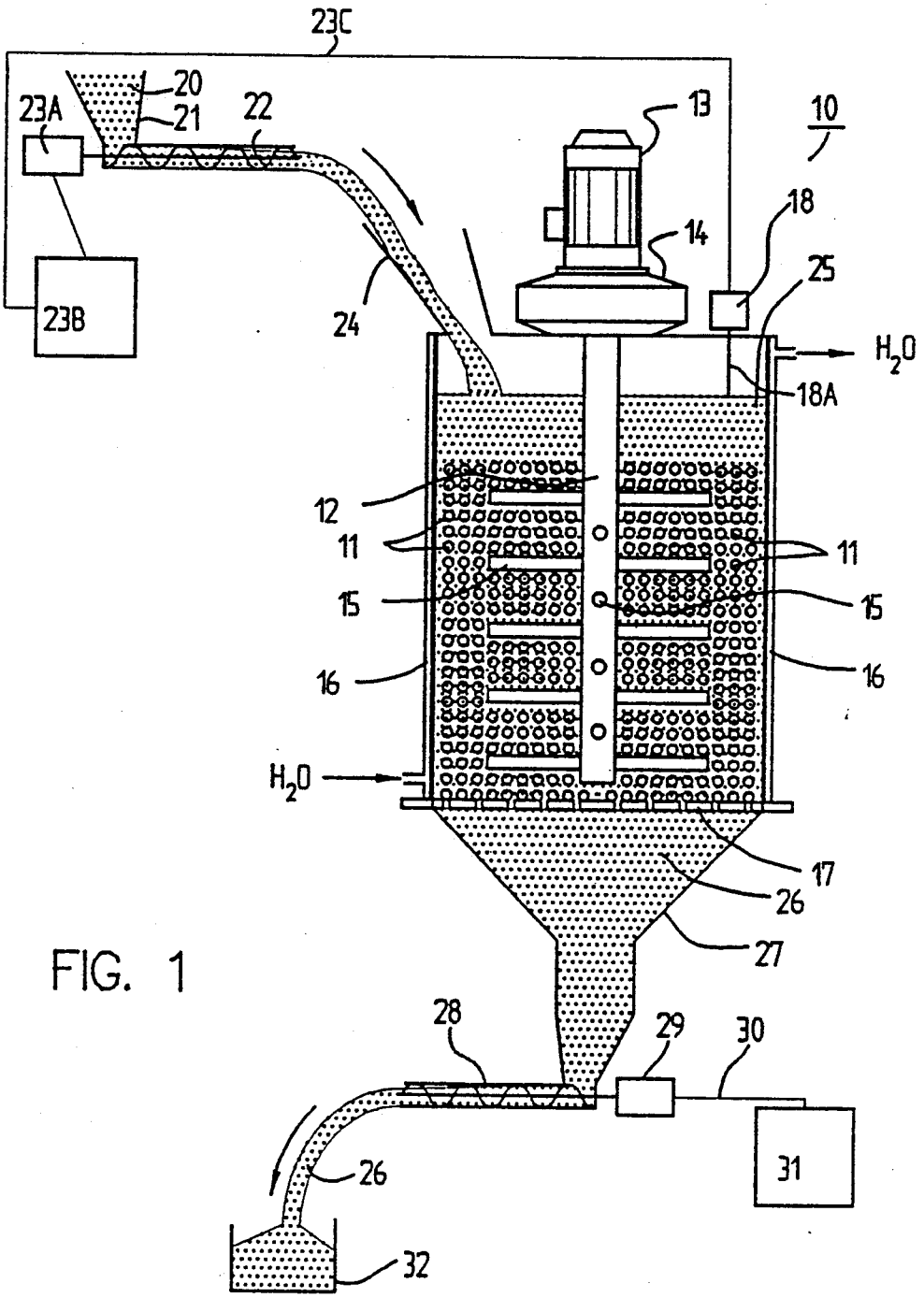
FIGS. 1 and 2 illustrates the inventive method practiced with the aid of preferred embodiments of the inventive arrangement.

Shown in the Figure is a mill 10 which operates with an agitated grinding medium 11 and which includes a rotor 12 which is driven by a motor 13 through the intermediary of a planet gear 14. The rotor 12 is provided with pins 15 which extend substantially perpendicular from the rotor, in four different directions. The mill 10 is cooled by a water-filled jacket 16, to and from which water is continuously introduced and removed through respective inlets and outlets marked with arrows and referenced $H_2O$. Fitted to the bottom part of the mill 10 is a metal bottom plate 17 which is provided with downwardly-conical, circular openings which are adapted to hold the grinding media separate but which allow the ground material to pass therethrough. Mounted on the upper part of the mill 10 is a level monitor 18, which may be provided with a fork sensor 18A.

Figure 2:
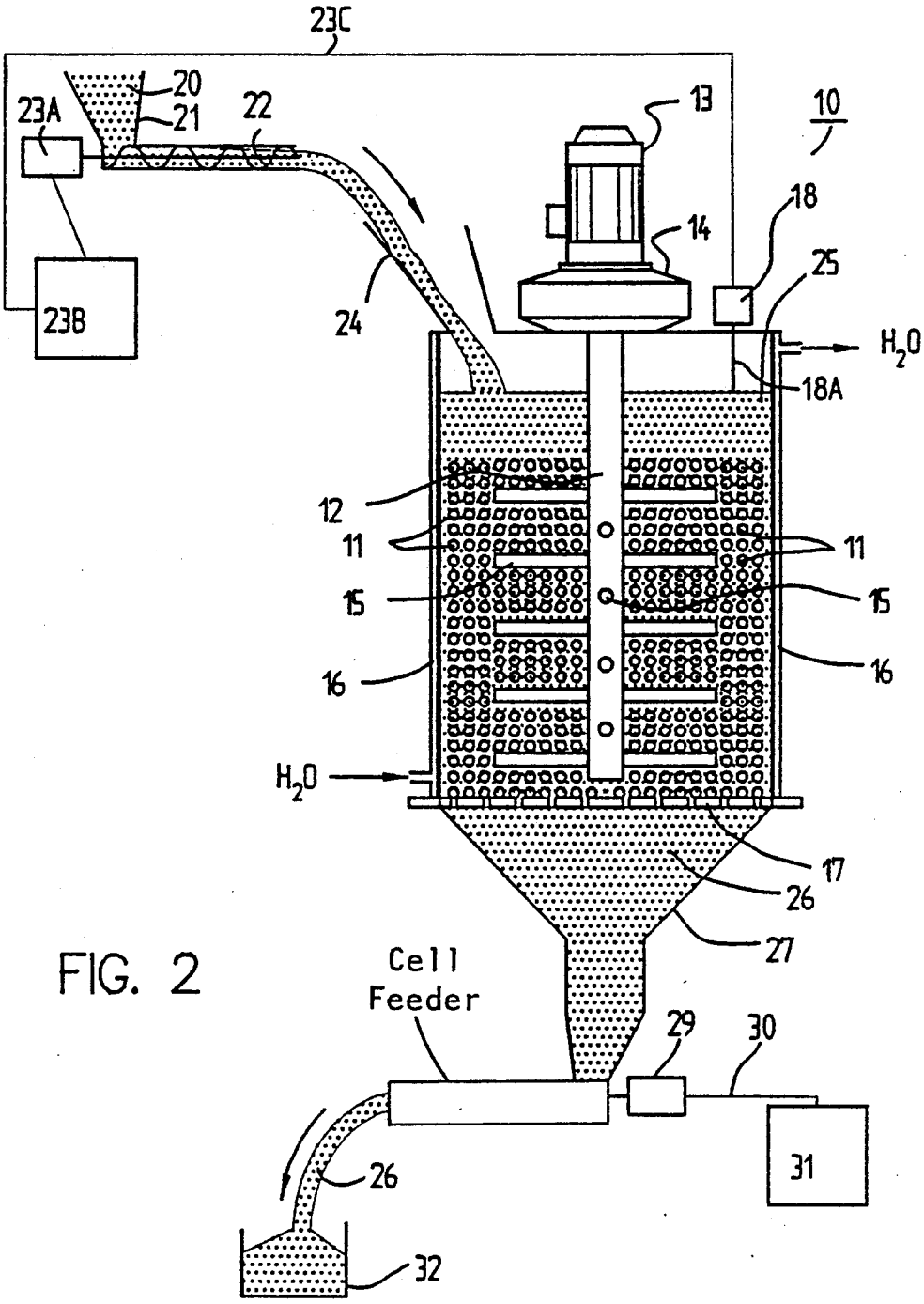

Material 20 to be finely ground in the mill is fed, via a hopper 21, through a screw feeder 22, the speed of which is controlled so as to feed a predetermined quantity of material to the mill with each unit of time, said control being effected with the aid of a drive means 23 comprised of a motor 23A and a speed-regulating device 23B. When the material 20 in the mill 10 reaches a highest permitted value, a signal is produced by the level monitor 18 and transmitted on a line 23C, such that the infeed of material is interrupted subsequent to the lapse of a given period of time after the monitor 18 has produced said signal. The level monitor 18 may suitably be provided with a clock which automatically produces a signal to recommence loading of material into the mill after a predetermined period of time has lapsed. The material 20 is charged to the mill 10 through a filling funnel 24. It is ensured that only material 20 charged to the mill is present in the upper part 25 thereof, whereas the remainder of the mill 10 shall also include grinding medium 11. The ground material, referenced 26, is sieved from the grinding medium on the bottom plate 17 and is transported, in the form of a coherent flow of material, through a funnel 27 and to a motor-driven discharge device 28, which in the FIG. 1 has the form of a screw feeder having a continuously adjustable feeding speed, and in the FIG. 2 has the form of a cell feeder. The screw feeder 28 is driven by a motor 29 whose speed can be controlled by a control device 31, via a line 30. The control device 31 may have the form of a variator or a frequency converter.

In operation, the outflow of finely-ground material 26 is first adjusted with the aid of the outfeed device 28, the motor 29 and the control device 31. The flow of in going material 20 is then adjusted by adjusting the speed of the screw feeder 22 with the aid of the drive means 23A,B, so as to ensure that the level of the material in the upper part 25 of the mill 10 will increase in accordance with the selected infeed of material. When the infeed and outfeed flows of material have been set and finely adjusted in the aforedescribed manner, and the upper level of the material 20 reaches the sensor 18A of the level monitor 18, a signal is sent from the level monitor 18 to the speed-regulating device 23B, through the cable 23C, causing an interruption in the infeed of material 20. Subsequent to the lapse of a given period of time, the device 23B receives a further signal, in response to which the infeed of material is continued. Ground material 26 is discharged through the screw feeder 28 in an essentially constant, predetermined flow during the whole of the grinding process, this discharged, ground material 26 being collected in a storage container 32.

What is claimed is:

1. A method for finely-grinding minerals and similar material intended for use as a filler to particle sizes which are appropriate for this purpose, with the aid of a mill having a cavity, the mill operates with an agitated grinding medium in the cavity and in the cavity the material is ground in a substantially dry state, wherein said method comprises the steps of:

predetermining the stay time of the material in the cavity in the mill to obtain a ground material having particle sizes suitable for use as a filler;

grinding the material in the mill in a substantially dry state with an agitated grinding medium to produce said ground material having particle sizes suitable for use as a filler;

maintaining the predetermined stay time;

partly by discharging ground material from the cavity in the mill at a predetermined, essentially constant rate; and partly by adjusting the infeed of material to the cavity in the mill in relation to the quantity of material discharged from the mill such that the amount of material present in the cavity in the mill will increase during the infeed of material thereto;

monitoring the height level of the material in the cavity to determine the height of the material in the mill; and interrupting the infeed of material to the cavity in the mill when the height level of the material in the cavity is over a predetermined highest height level in the cavity in said mill.

2. An arrangement for carrying out a method for finely-grinding minerals and similar material intended for use as a filler to particle sizes which are appropriate for this purpose, with the aid of a mill having a cavity, the mill operates with an agitated grinding medium in the cavity and in the cavity the material is ground in a substantially dry state, wherein said method comprises the steps of:

predetermining the stay time of the material in the cavity in the mill to obtain a ground material having particle sizes suitable for use as a filler;

grinding the material in the mill in a substantially dry state with an agitated grinding medium to produce said ground material having particle sizes suitable for use as a filler;

maintaining the predetermined stay time;

partly by discharging ground material from the cavity in the mill at a predetermined, essentially constant rate, and partly by adjusting the infeed of material to the cavity in the mill in relation to the quantity of material discharged from the mill such that the amount of material present in the cavity in the mill will increase during the infeed of material thereto;

monitoring the height level of the material in the cavity to determine the height of the material in the mill; and interrupting the infeed of material to the cavity in the mill when the height level of the material in the cavity is over a predetermined highest height level in the cavity in said mill; and said arrangement comprising:

a first motor-driven device which functions to control the infeed of material to the cavity;

a perforated disc disposed within the cavity, which perforated disc functions to isolate the grinding medium from the ground material leaving the mill;

a second motor-driven device which functions to maintain a substantially constant outfeed of ground material from the cavity in the mill; and a level monitor for said monitoring of a height level of the material in the cavity, the level monitor being mounted in the upper part of the cavity in the mill and connected to the motor-driven infeed device to control the motor driven infeed device as a function of the height level of material present in the mill.

3. The arrangement according to claim 2, wherein at least one of: the outfeed device and the infeed device is a continuously controllable screw feeder.

4. The arrangement according to claim 3, wherein the outfeed device is a continuously controllable cell feeder.

5. The arrangement according to claim 3, wherein the level monitor includes a fork sensor.

6. A method for grinding raw materials in a mill, the mill comprising a cavity for containing a grinding medium, the grinding medium being agitated by stirring to grind the raw materials in the cavity, and the material being ground in the cavity in the mill in a substantially dry state for at least a portion of a predetermined stay time of the material within the cavity in the mill, said method comprising the steps of:

predetermining the stay time of the material in the cavity in the mill, the predetermined stay time being sufficient for producing a ground material having a predetermined particle size;

feeding the raw material into the cavity in the mill;

stirring the grinding medium to grind the raw materials in the cavity to produce a ground material;

maintaining the raw material in the cavity for the predetermined stay time to produce the ground material having the predetermined particle size;

discharging the ground material from the cavity in the mill;

maintaining the predetermined stay time by controlling feed of the raw material into the cavity and controlling discharge of ground material exiting the cavity, said maintaining comprising:

monitoring the height level of raw material in the cavity in the mill; and maintaining the height level of raw material in the cavity within a range by starting and stopping the feed of the raw material into the cavity.

7. The method according to claim 6, wherein:

said material contains less than 0.5% moisture; and said grinding comprises grinding the raw material to produce a ground raw material of which 97% has a particle size of less than 45 micrometers.

8. The method according to claim 7, wherein:

said maintaining the height level of raw material within a range comprises maintaining the height level of raw material between a first height level and a second height level, the first height level being lower than the second height level; and said method further comprises:

maintaining said discharge of ground material exiting the mill constant;

starting said feed of raw material into the mill upon the height level of the raw material in the mill reaching said first height level; and stopping said feed of raw material into the mill upon the level of the raw material reaching said second height level.

9. The method according to claim 8, wherein:

said feed of raw material into the mill is greater than said discharge of raw material exiting the mill to increase the height level of material in the mill during feeding of the raw material into the mill.

10. The method according to claim 9, wherein:

said grinding comprises grinding the raw material to produce a raw material having a surface area of greater than 400 $m^2/kg$; and said grinding comprises grinding the raw material to a particle size of less than 10 micrometers.

11. The method according to claim 10, wherein:

said grinding comprises grinding in a stirred ball mill, the stirred ball mill being arranged substantially vertically; and said method further comprises:

feeding the raw material into a top of the stirred ball mill; and discharging the ground material from a bottom of the stirred ball mill.

12. The method according to claim 11, wherein:

said feeding the raw material into the top of the stirred ball mill comprises feeding the raw material into the top of the stirred ball mill with a motor-driven screw feeder; and said discharging of the ground material from the bottom of the stirred ball mill comprises discharging the ground material from the bottom of the stirred ball mill with a motor-driven screw feeder.

13. The method according to claim 12, wherein said grinding comprises grinding the raw material to a particle size of less than 2 micrometers.

14. The method according to claim 7, wherein:

said maintaining the height level of raw material within a range comprises maintaining the height level of raw material between a first height level and a second height level, the first height level being lower than the second level;

said feed of raw material into the mill is greater than said discharge of raw material exiting the mill; and said method further comprises:

stopping said feed of raw material into the mill upon the height level of the raw material reaching said second height level; and starting said feed of raw material into the mill a predetermined period of time after the feed of the raw material is stopped.

15. The method according to claim 14, wherein:

said grinding comprises grinding the raw material to produce a raw material having a surface area of greater than 400 $m^2/kg$; and said grinding comprises grinding the raw material to a particle size of less than 10 micrometers.

16. The method according to claim 15, wherein:

said grinding comprises grinding in a stirred ball mill, the stirred ball mill being arranged substantially vertically; and said method further comprises:

feeding the raw material into a top of the stirred ball mill; and discharging the ground material from a bottom of the stirred ball mill.

17. The method according to claim 16, wherein:

said feeding the raw material into the top of the stirred ball mill comprises feeding the raw material into the top of the stirred ball mill with a motor-driven screw feeder; and said discharging of the ground material from the bottom of the stirred ball mill comprises discharging the ground material from the bottom of the stirred ball mill with a motor-driven screw feeder.

18. The method according to claim 17, wherein said grinding comprises grinding the raw material to a particle size of less than 2 micrometers.

* * * * *

UNITED STATES PATENT AND TRADEMARK OFFICE

CERTIFICATE OF CORRECTION

PATENT NO. : 5,242,122

DATED : September 7, 1993

INVENTOR(S) : Jan O. BOGEN

It is certified that error appears in the above-indentified patent and that said Letters Patent is hereby corrected as shown below:

On the title page of patent, item 54, after 'MINERALS', insert --INTENDED--.

In column 1, line 2 of the title, after 'MINERALS', insert --INTENDED--.

In column 4, line 37, after '2', delete "illustrates" and insert --illustrate--.

Signed and Sealed this

Nineteenth Day of July, 1994

Bruce Lehman

*Attest:*

BRUCE LEHMAN

*Attesting Officer*

*Commissioner of Patents and Trademarks*